US011472060B1

(12) United States Patent
Essary

(10) Patent No.: US 11,472,060 B1
(45) Date of Patent: Oct. 18, 2022

(54) MECHANICAL BINDING LOG SPLITTER BLADES

(71) Applicant: Joshua Essary, Leighton, IA (US)

(72) Inventor: Joshua Essary, Leighton, IA (US)

( * ) Notice: Subject to any disclaimer, the term of this patent is extended or adjusted under 35 U.S.C. 154(b) by 111 days.

(21) Appl. No.: 15/929,688

(22) Filed: May 15, 2020

Related U.S. Application Data

(60) Provisional application No. 62/848,389, filed on May 15, 2019.

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06; B27L 7/08
See application file for complete search history.

(56) References Cited

U.S. PATENT DOCUMENTS

| | | | | |
|---|---|---|---|---|
| 3,077,214 A | | 2/1963 | Brukner | |
| 3,280,864 A | | 10/1966 | Spanenberg | |
| 3,319,675 A | | 5/1967 | Bles, Sr. | |
| 3,974,867 A | | 8/1976 | Butas, Jr. | |
| 4,141,396 A | | 2/1979 | McCallister | |
| 4,378,825 A | * | 4/1983 | Schroeder | B27L 7/00 144/193.1 |
| 4,391,312 A | * | 7/1983 | Sakraida, Jr. | B27L 7/06 144/195.1 |
| 4,461,331 A | * | 7/1984 | Mertz | B27L 7/00 144/195.1 |
| 4,515,194 A | * | 5/1985 | Dankel | B27L 7/06 144/195.1 |
| 5,669,455 A | | 9/1997 | Dietrich | |
| 7,556,072 B2 | * | 7/2009 | Koch, Jr. | B27L 7/00 144/193.2 |
| 8,091,595 B2 | * | 1/2012 | Windrich | B27L 7/00 144/4.6 |
| 9,387,599 B1 | * | 7/2016 | Newman | B27L 7/06 |
| 2006/0214380 A1 | | 9/2006 | Dietle | |
| 2011/0048581 A1 | * | 3/2011 | Hicks | B27L 7/06 144/195.8 |
| 2011/0079323 A1 | * | 4/2011 | Green | B27L 7/06 144/195.8 |

FOREIGN PATENT DOCUMENTS

WO 02063185 A1 8/2002

* cited by examiner

*Primary Examiner* — Matthew Katcoff
(74) *Attorney, Agent, or Firm* — McKee, Voorhees & Sease, PLC

(57) ABSTRACT

The present invention relates to a mechanized log splitter (or other powered ram application) and removable blade assembly The difference between this Mechanical Binding Log Splitter Blade assembly and traditional blade(s) is that the blade assemblies according to the invention are interchangeable without the time consuming use of mechanical fasteners or permanent adhesion of a welding process. On most log splitters the blades are either welded or bolted onto the splitter. With a Mechanical Binding Log Splitter Blade according to my invention, this is not necessary. Traditionally the blades were only changed or removed when and if they got damaged. By eliminating fasteners and welding it allows the operator a quick way to install the optimal bade for his operation.

16 Claims, 6 Drawing Sheets

MECHANICAL BINDING LOG SPLITTER BLADES

CROSS-REFERENCE TO RELATED APPLICATIONS

This application claims the benefit of Provisional Application U.S. Ser. No. 62/848,389 filed on May 15, 2019, all of which is herein incorporated by reference in its entirety.

BACKGROUND OF THE INVENTION

The field of endeavor of the invention is that of a mobile and hydraulically powered ram that is designed to split logs. There are a large number of other machines that have been built in a similar manner and some of them can be found under U.S. Pat. Nos. 4,141,396; 3,974,867; 3,077,214; 3,280,864; and 3,319,675, which are incorporated by reference here as background information on the general components and functioning of the type of machine to which the invention can be applied. The limitation of these machines is that the wedge, or blade, is generally fastened using a permanent or time-consuming method. There are designs that use adjustable blades, but these are costly and require an extra hydraulic circuit to manipulate the blade.

SUMMARY OF THE INVENTION

The invention is a mechanically binding log splitter blade that is attached to the main structure of the splitter without fasteners or the use of a welding process. It also excludes the need for hydraulically adjusted blades. The invention is designed for, and allows, quick interchanging of the blades or wedges used to split logs. The benefit of invention is that it is both fast and versatile. It will allow the operator to select the ideal blade for his application. In addition, it will also allow the operator to change the blade without tools and in a matter of seconds.

In one aspect of the invention, a log splitter or powered ram machine comprises a main frame assembly having opposite ends along an end-to-end longitudinal axis, and orthogonal side-to-side lateral and up-and-down sagittal axes relative to the longitudinal axis. A removable blade assembly is held in place on the log splitter main frame assembly by a mechanically binding system that is not comprised of fasteners. The mechanically binding system comprising complementary mechanical structural features on both the removable blade assembly and on the mainframe assembly that allow meshing when assembled together to resist relative movement parallel to the longitudinal axis of the mainframe assembly but allow separation in a separation direction other than parallel to the longitudinal axis.

In another aspect of the invention, the above machine can additionally include a mechanical restraint against rotation of the removable blade assembly in the separation direction.

In another aspect of the invention, a method of allowable removable/interchangeable blades for a log splitter machine or powered ram machine without use of tools utilizes a mechanically binding system to provide fixed restraint of freedom of movement of the blade assembly in all directions relative the main assembly except a separation direction. This allows the blade assembly to be moved manually and freely until installed in the mechanically binding system, where it is then restrained against translation or rotation during operation of the log splitter machine or powered ram machine.

DETAILED DESCRIPTION OF EXEMPLARY EMBODIMENTS OF THE INVENTION

Overview

For a better understanding of the invention and its various aspects, examples of several forms and embodiments according to the invention will be set forth in detail. These descriptions will frequently be with reference to the accompanying drawings which are summarized in the Brief Description of the Drawings supra.

As will be appreciated by those skilled in this technical art, the invention can take many forms and embodiments. The embodiments discussed below are neither inclusive nor exclusive of all forms and embodiments. For example, variations obvious to those skilled in this technical art will be included with the invention, which is defined by the claims at the end of these descriptions.

Figure 2:
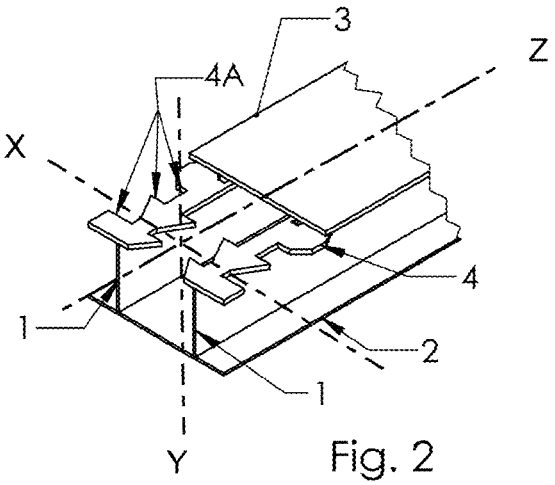
FIG. 2 is an enlarged isolated view of the portion of FIG. 1 indicated by circle 2. An axis system is superposed for reference.

An XYZ axes is superposed at FIG. 2 and will referred to from time to time to assist in understanding. For purposes of description only, the Z axis is intended to correspond generally with a longitudinal axis along the main assembly and, typically, during normal operation the Z axis would be relatively horizontal (but could vary depending on terrain or set up). The X axis is intended to correspond generally with an orthogonal transverse and generally horizontal axis relative the longitudinal axis or left and right side relative the longitudinal axis. The Y axis is intended to correspond generally with a vertical axis and is sometimes called the sagittal axis (because this axis typically will be generally vertical but not exactly vertical). Furthermore, to assist in understanding, the XY plane will sometimes be called the lateral or transverse plane, the YZ plane sometimes the median or sagittal plane, and the XZ plane the longitudinal plane.

In the context of the foregoing axes system, to assist in understanding in the descriptions below, from time-to-time these axes or planes will be referred to, including how the embodiments operate, sometimes subtly, in terms of mechanically controlling freedom of movement of the blade assembly relative the mainframe assembly. In the context of structural analysis terms, the embodiments control at least several of X, Y, and/or Z translation, and X, Y, and/or Z rotation.

For example, some embodiments present fixed restraint of freedom of movement of the blade assembly, once in installed position, relative to X and Z translation, and relative to downward Y translation. This leaves a released state or ability to move the blade assembly at least some distance in the upward Y translation direction. As such, this embodiment restrains the blade by mechanical stops against movement in the XZ longitudinal plane (a plane generally parallel with and along the top of the main assembly rail). As such, this restraints movement of the blade assembly in the XZ plane even when substantial forces are applied against it by pressing of a workpiece (e.g. log) against it by a ram moving along the mainframe rail.

But, further, some embodiments present fixed restraint of freedom of movement of the blade assembly when installed relative to all but one release translation. In some embodiments this means restraint against translation in all of XZ, XY, and YZ planes except for one release translation direction. In the following embodiments, one example of the release direction is upwardly in the XY plane direction.

Still further, some embodiments additionally present at least some restraint of freedom of movement even in the release direction. As further explained below, these embodiments allow relative translation of the blade assembly to the mainframe assembly in at least one direction to move the blade assembly into position for mechanical binding by mating complimentary structural features of the blade and mainframe assemblies by moving the blade assembly in the release direction. But once mated, these embodiments at least then limit some translation of the blade assembly in the release direction. One example is the ability to translate or slide the blade assembly basically longitudinally relative the mainframe assembly until the complementary structure of the blade assembly are aligned over the complimentary structure in the main frame assembly. Then, the blade assembly has at least some freedom of movement/translation downward to mate the complementary structures to essentially lock them together. This would be a different direction, and one example of a release direction, at least somewhat different than the direction of the first movement to get the blade assembly into position for mating. This arrangement then allows structure to at least somewhat limit range of translation of the blade assembly back out of mating along the release direction. This can provide for still further restraint of freedom of movement during operation of the machine. These concepts will be furthered by reference to the examples discussed the embodiments below.

First Exemplary Embodiment

With particular reference to FIGS. 1-17 a first exemplary embodiment is illustrated. The overall machine or apparatus is a powered log splitter which includes an elongated mainframe or rail between opposite ends along its longitudinal axis. At or associated with one end is ram that is retained but slidable along the mainframe or rail towards the opposite end. A blade is associated with the opposite end of the mainframe or rail. A log can be placed between the ram and blade when they are separated. Applied force from some type of controllable actuator allows controlled convergence of the ram towards the blade which, in turn, forces the log into the blade. An example of a controllable actuator is a hydraulic ram with user-control of a hydraulic circuit/pump that is, in turn, powered by an engine (e.g. gasoline, electric, or other). By applying sufficient force/pressure to overcome the resistance to cutting, fracture, deformation, or splitting [tensile and compressive strength], sometimes called cutting strength of the log, the blade automatically splits the log. The limit of travel of the ram can be confined to just short of abutment with the blade. The ram can be moved back to a starting position for another log. These general operational features are typical of mechanized log splitters.

One feature of this embodiment is a blade that can be attached and detached manually and quickly and easily. In this embodiment, it uses a key and slot arrangement to set the blade against longitudinal movement at or near the plane of the mainframe/rail (even over the range of applied forces it will experience via the powered ram), but quick and easy liftoff transverse or oblique of the longitudinal axis to remove the blade. As such, this embodiment limits freedom of movement of the blade assembly when in installed position at least against translation in both directions relative the X and Z axes, but also in one direction (downward) in the Y directions. Thus, the release direction is upward in the Y direction. The limit of freedom of translation is mechanical restraint.

The benefits of such an arrangement are many. They include the ability for a single person to easily and quickly manually detach a blade for maintenance, repair, substitution, or transit without assistance or tools. Similarly, it allows a user to attach the blade without assistance or tools. This is counter-intuitive because of the robustness needed in a blade that experiences the type of forces needed to split logs. It is counter-intuitive to not require there by fasteners or hardware requiring tools to attach or detach such blades.

As will be further discussed below, this embodiment includes the optional feature of further limit of freedom of movement of the blade assembly when installed. A combination of an extension from the blade assembly fits in complementary fashion into a receiver in the mainframe assembly that at least somewhat mechanically further restrains movement of the blade assembly in the release direction. As explained below, in this embodiment, the subtlety is that by designing the geometries and form factors of the extension and receiver, the blade assembly can be manually but easily manipulated in an at last somewhat different direction than the release direction to proximity of mating with the mechanically binding features of the mainframe assembly, but then manipulated at least generally in the release direction into mating. The geometries and form factors of extension and receiver, in this embodiment, both provide a mechanical stop or restraint that limits the maximum separation of the blade assembly from the mainframe assembly in the release direction, but also restraints rotational translation of the blade assembly in the YZ plane (or around the X axis). This promotes the blade assembly to remain in installed position against the typical forces experienced in such a machine during operation yet retains the ability to remove it. Removal would be first for a distance in the release direction and then in the removal direction different from the release direction.

As will be appreciated by those skilled in the art, these features can take different forms and embodiments.

How to Make the First Embodiment

Figure 1:
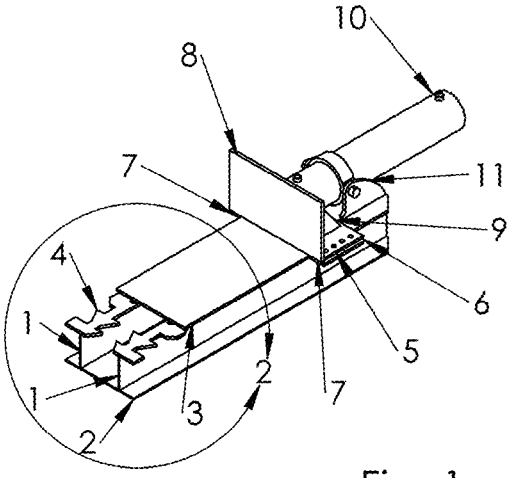
FIG. 1 is an assembled perspective view of one exemplary embodiment of the present invention.
Figure 3:
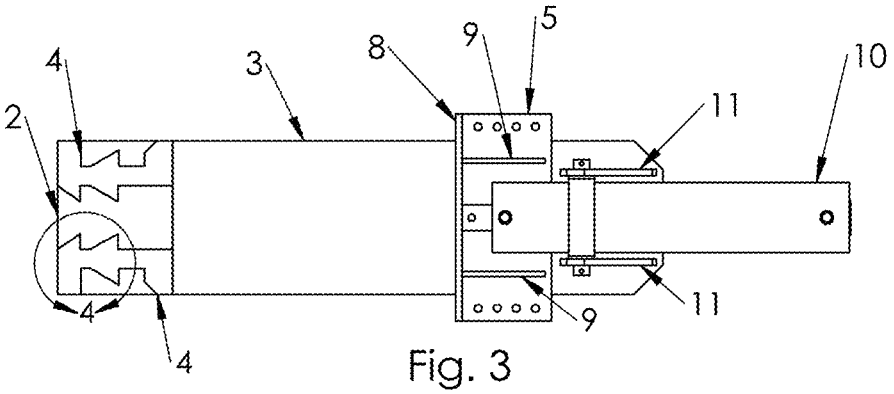
FIG. 3 is a slightly enlarged top plan view of the embodiment of FIG. 1.
Figure 4:
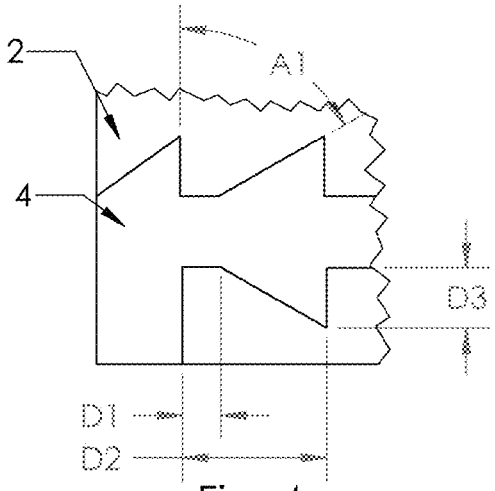
FIG. 4 is an enlarged isolated view of the portion of FIG. 3 indicated by circle 4.

The first view of the first embodiment is an isometric view at FIG. 1 of the drawings, and it is used primarily to give, in isolation, a three dimensional view of the mainframe weldment, which includes modifications according to one example of my invention. FIG. 2 is an enlarged detailed view of the area indicated at line 2 of FIG. 1, and it is used to magnify the mechanical stops that are welded to the mainframe. FIG. 3 is also included on this page and is used to show the top view of the mechanical stops of FIGS. 1 and 2. FIG. 4 is an enlarged detailed view of the area indicated by line 4, and it is used to show dimensional detail of how the mechanical stops could be formed.

Figure 5:
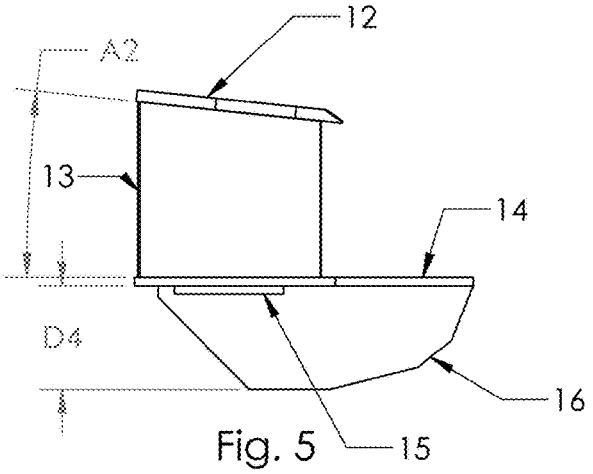
FIG. 5 is an isolated side elevation of the attachable/detachable blade of embodiment of FIG. 1.
Figure 6:
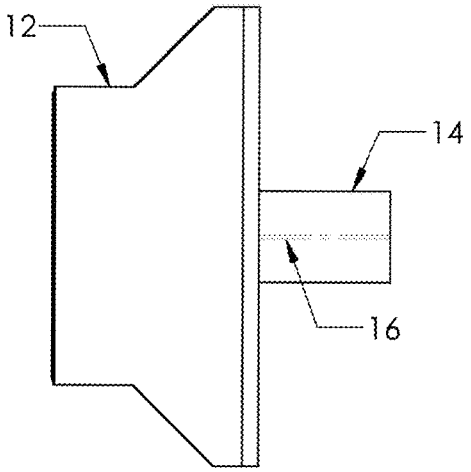
FIG. 6 is a top plan view of FIG. 5.
Figure 7:
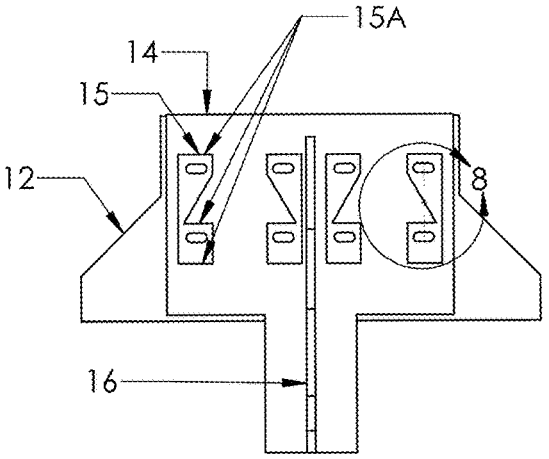
FIG. 7 is a bottom plan view of FIG. 5.
Figure 8:
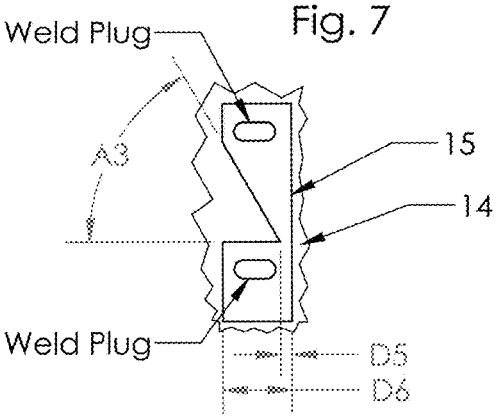
FIG. 8 is an enlarged isolated view of the portion of FIG. 7 indicated by circle 8.

FIG. 5 is, in isolation, a side view of a freely attachable/detachable blade assembly according to one example of my invention. It is used to show how a second set of mechanical stops, complementary to the set on the mainframe, are welded to the blade. It also shows a generally convex extension feature at the bottom front of the blade assembly. FIG. 6 is a top plane view of FIG. 5 and further illustrates how the convex extension sticks out from the vertical blade edge. Later the convex extension will be further explained. FIG. 7 displays a bottom plane view of the blade of FIG. 5. This view is used to show the geometry of the mechanical stops as well as how they are welded to the blade assembly. FIG. 8 is a detailed view of the area indicated by line 8, and it is used to show dimensional detail of how the stops could be formed.

Figure 9:
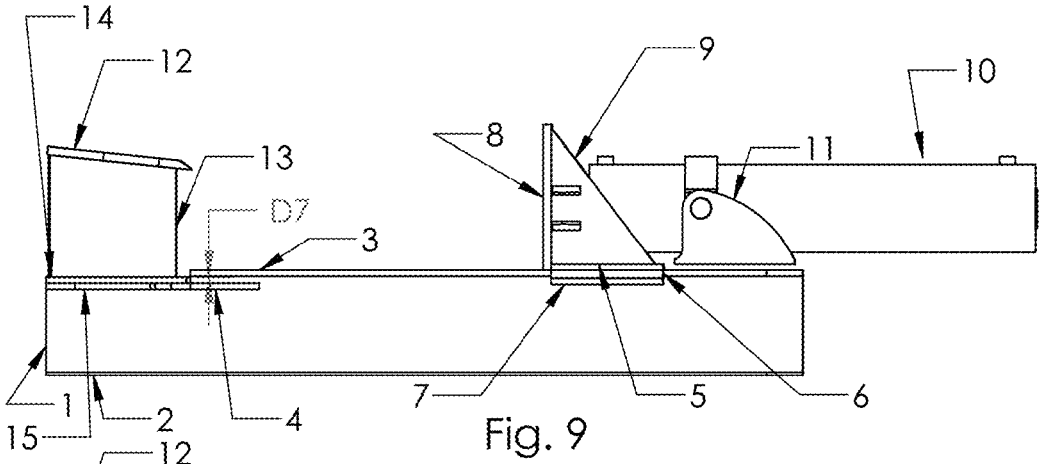
FIG. 9 is a side elevational view of the embodiment of FIG. 1 with the blade attached and in operable position.

FIG. 9 is primarily used to show how the parts of the machine are assembled and lock together. The side elevation of FIG. 9 shows the blade assembly of FIGS. 5-8 mounted on the mainframe assembly of FIGS. 1-4. This projection shows how two sets of weldments will fit together.

One way to discuss the mating of the complementary structural elements of the blade assembly and the mainframe assembly is in terms of slots and keys. As shown in the Figures, in this embodiment, the tooth-shaped spaces in the mainframe assembly can be called slots with a triangular perimeter shape and a depth. The tooth-shaped features on the blade assembly have a complimentary outer shape and form factor to the slots and can be called keys which fit into the slots. In this embodiment, the thickness of the keys is at least on the order of the depth of the slots. The slots are closed off at the bottom of their depths; here by a surface of the mainframe rail or otherwise to serve as a mechanical stop or restraint against further movement in the Y-direction, and to ensure the thicknesses of the slots match up in the XZ plane with the thicknesses of the keys. This allows effective use of the surface areas of those thicknesses against the forces that are typically experienced during operation of the machine. As will be appreciated, those surface areas, the materials used for them, and the amount of such surface area are variables the designer can select from for a given application according to need or desire. As will be appreciated, in this embodiment the mating teeth (keys in slots) are plural and in series in the longitudinal direction (generally the Z direction). This can enhance the restraint against translation along the longitudinal axis (Z direction) during typical forces during operation of the machine.

As further discussed below, restraint or handling of bi rotational forces can also be addressed by this embodiment. This allows both restraint against translation of the blade assembly longitudinally but also in the separation direction. In other words, it is subtle but effective way to allow installation and removal of the blade assembly without tools by dropping the keys into the complementary slots in the separation direction, but once mated in that fashion, deter/restraint mechanically attempts of the blade assembly to move out of mating, such as by rotation that might lift one or more keys out of the slots and thus present the potential of disengagement of the blade from the mainframe assembly.

Figure 10:
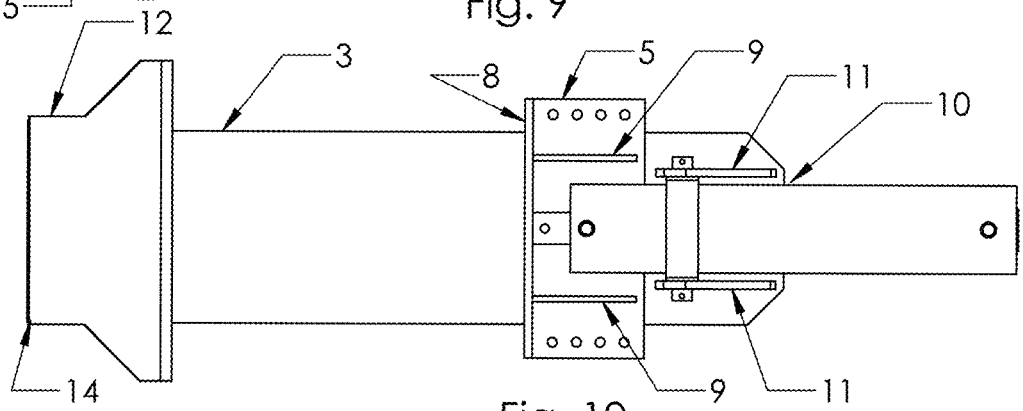
FIG. 10 is a top plan view of FIG. 9.
Figure 11:
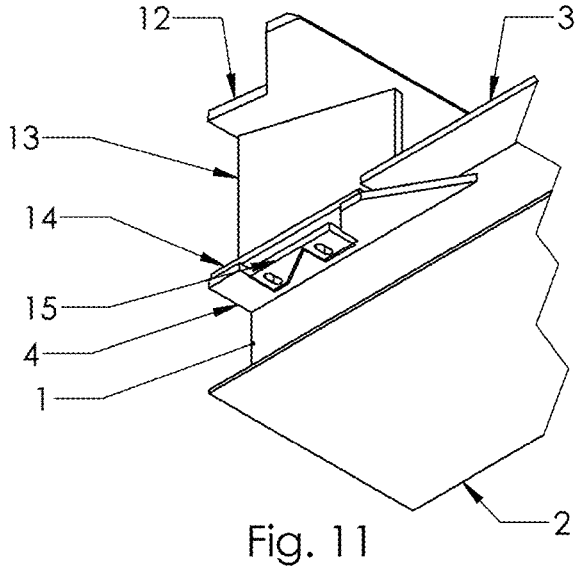
FIG. 11 is a partial perspective of the blade end of the assembled embodiment of FIGS. 9 and 10 from a bottom viewing direction.

FIG. 10 is a top projection or plan view of FIG. 9. FIG. 9 is also used to show how the convex extension is used to keep the blades from flipping backwards (restrains rotation in a direction parallel the X axis). The convex extension of ref. no. 16 and the leading extension of plate 14 of the blade assembly are underneath Ref. No. 3 horizontal plate 3 of the main beam (see gap between bottom of plate 3 and top of plates 4 in FIG. 11), and when a force is applied to the blades 13 of the blade assembly, the extension on the front of the blade assembly pushes up against the mainframe. The mainframe then holds the blade assembly from rotating backward. FIG. 11 is a rotated enlarged isometric view of the blade end of assembled machine in isolation that is used to show how the mechanical stops bind together. This further illustrates how the geometries shown in sheet one and sheet two lock together to prevent sliding or separation between blade assembly and mainframe along the longitudinal axis of the machine. Therefore, the mating of teeth 4A and 15A, both sets, are mechanical stops against both fore and aft movement of the blade assembly relative to the main beam. They also deter lateral movement of the blade assembly. The plate 14 of the blade assembly sits on top pieces 4 of the main beam which provides a mechanical stop against downward movement of the blade assembly (in the downward Y direction) when installed on the main beam. As shown and explained, the blade assembly can be removed upwardly (in the upward Y or release direction). But as shown in FIGS. 9-14, the leading edge of horizontal plate 14 of the blade assembly slides a short distance under top plate 3 of the main beam when assembled. Top plate 3 is a mechanical stop against the blade assembly front leading edge 14 from flipping up and back during log splitting. The blade assembly can be easily removed because of the curved bottom edge of vertical plate 16 of the blade assembly. The back of the blade assembly is simply tilted up as in FIG. 14 and the leading edge 14 slid out from under main frame plate 3.

Figure 12:
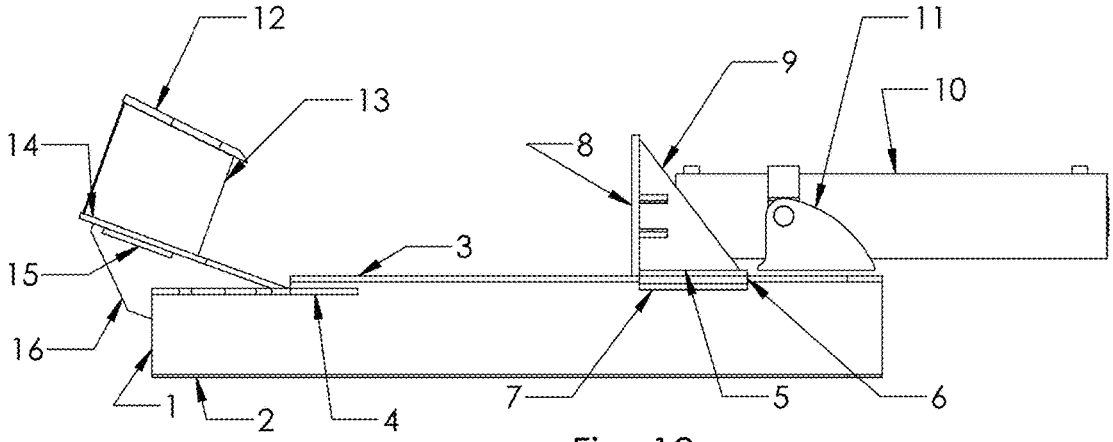
FIG. 12 is similar to FIG. 9 but shows the blade disassembled from the remainder of the apparatus.
Figure 13:
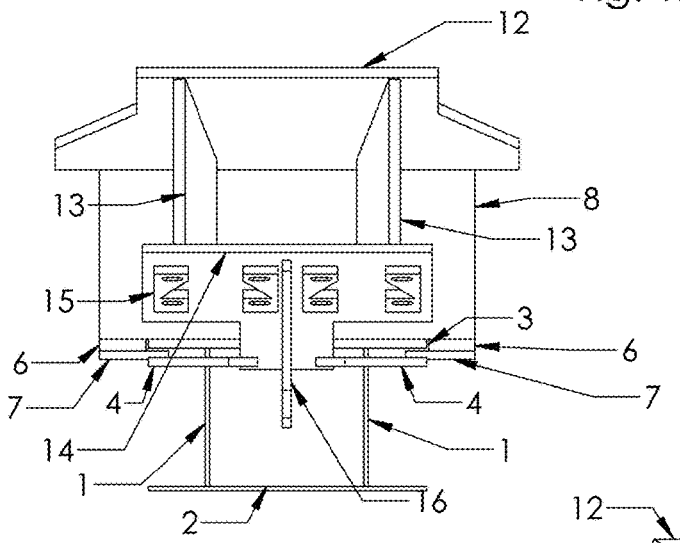
FIG. 13 is an end elevation of FIG. 12 from a left end viewing direction in FIG. 12.
Figure 14:
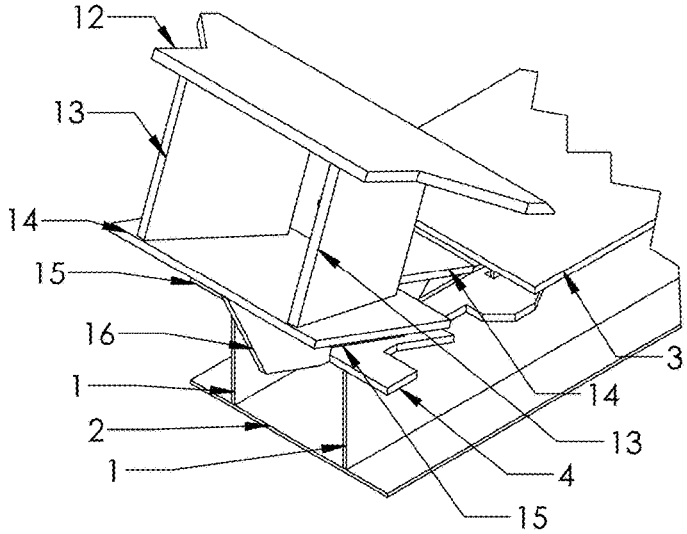
FIG. 14 is a partial perspective view of the end in FIG. 13.

The side view of FIG. 12 is used primarily to give, in isolation, a side view of how the mechanically binding blades will be inserted into the mainframe. This view serves to show how the blade would be tipped at a downward angle and then inserted into the mainframe. The next view FIG. 13 shows how the convex extension on the front of the blade will be placed between the two vertical supports of the mainframe. FIG. 14 is an isometric view showing approximately what the operator would be seeing. It also servers to further show how the convex extension will be inserted under the top plate of the mainframe.

Alternative Embodiment

Figure 15:
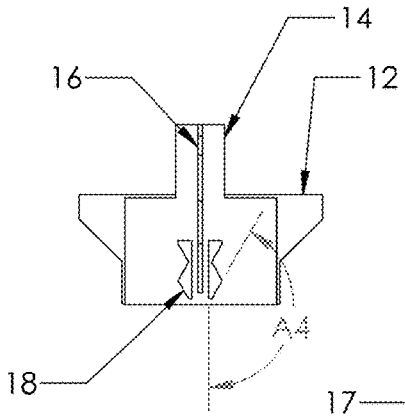
FIG. 15 is a bottom plan view of the blade isolated and removed from the remainder of the apparatus.
Figure 16:
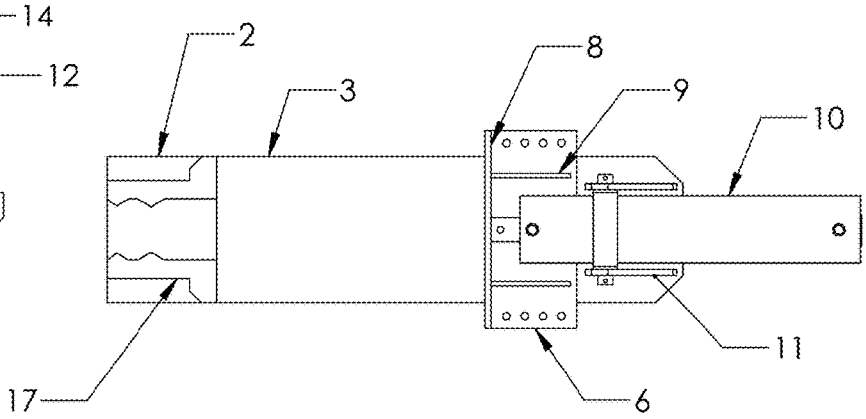
FIG. 16 is a bottom view of the remainder of the apparatus with the blade of FIG. 15 removed.
Figure 17:
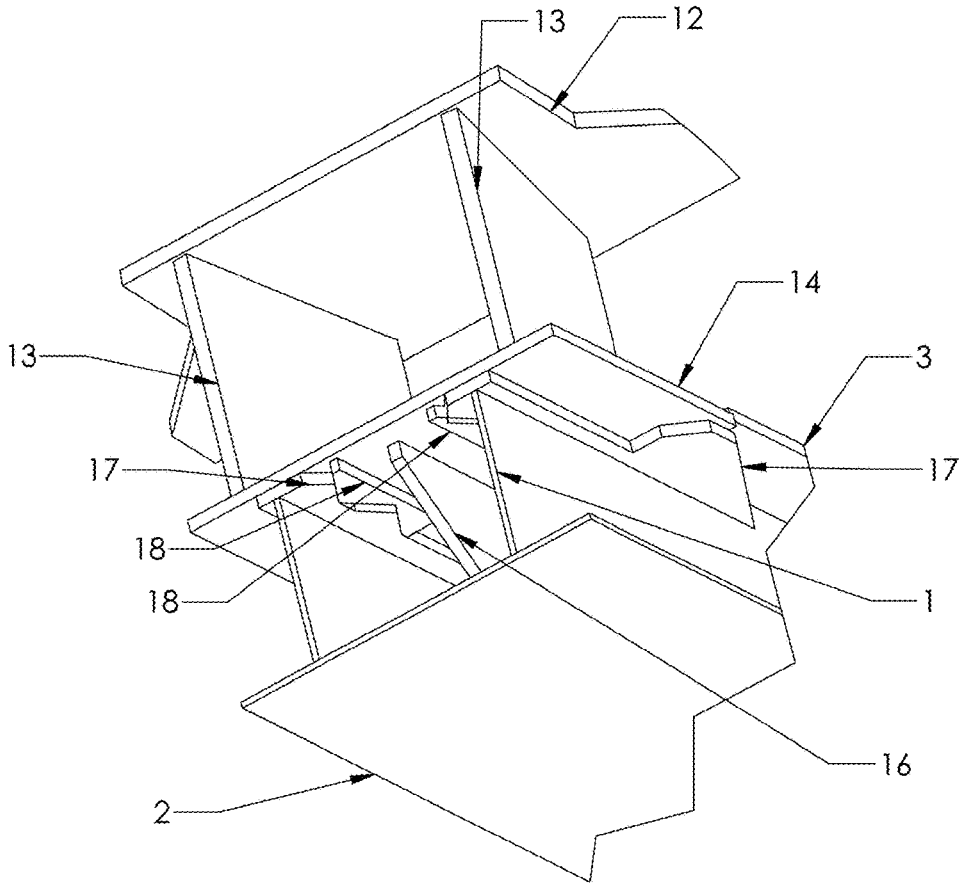
FIG. 17 is a slightly enlarged partial perspective view of the blade end of the remainder of the apparatus of FIG. 16 with the blade of FIG. 15 attached and in operative position.

FIGS. 15-17 illustrate another design both assembled and alternative geometries that are once again shown in isolation. FIG. 15 shows a different version of the serrated-shaped mechanical stops compared to FIGS. 1-14. In this version, the serrated-shaped mechanical stops are not perpendicular to the longitudinal axis of the mainframe. They are at an angle. This serves to help the blade center itself and to resist transvers rotation of the blade. It can also be seen that there is not an outside set of mechanical stops. The number of mechanical stops and geometry at which they are formed can be altered to suit the designer's needs. FIG. 16 shows the complimentary set of mechanical stops that are part of the mainframe, and FIG. 17 shows how the faces of the surfaces will meet when installed.

Alternative Embodiment

Figure 18:
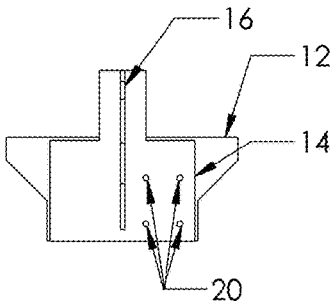
FIG. 18 is a bottom plan view of an alternative embodiment of a blade according to the invention isolated and removed from the remainder of the apparatus.
Figure 19:
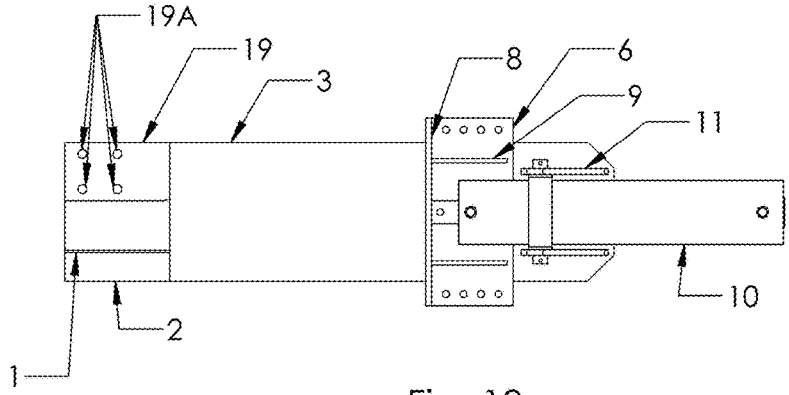
FIG. 19 is a bottom view of the remainder of the apparatus with the blade of FIG. 18 removed.
Figure 20:
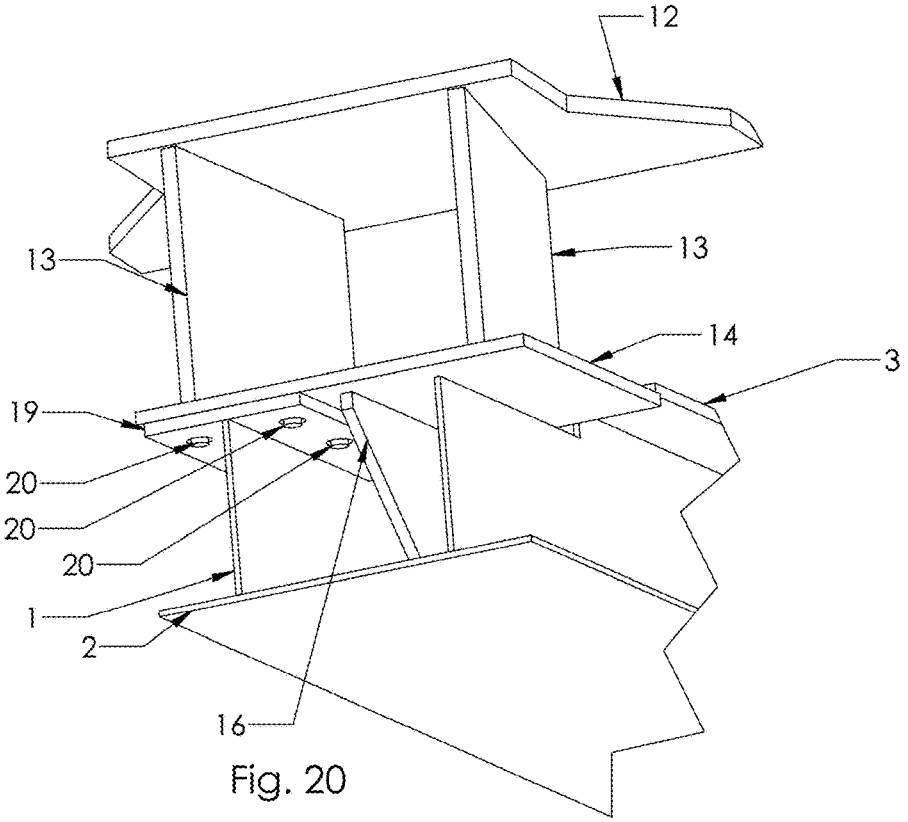
FIG. 20 is a slightly enlarged partial perspective view of the blade end of the apparatus of FIG. 19 with the blade of FIG. 18 attached and in operative position.

FIGS. 18-20 illustrate a still further design with alternative geometries. FIG. 18 shows a different version of the mechanical stops from the preceding embodiments. This time instead of the stops being serrated in shape they are curved in nature. This is just one example of a mechanical binding system that is round in nature. This time the stops are peg shaped instead of flat, and they are also arranged in a unique geometry that resists transvers rotation. As can be seen in the drawing, they are only applied to one side of the blade. Previously both sides of the blade had been symmetrical about the center axis, however it is not necessary. FIG. 19 shows how the mainframe is constructed to bind with the blade, and FIG. 20 shows how the two structures will rest when assembled.

Operation of the Embodiments

The following description provides understanding of how the blade assemblies of the foregoing embodiments of the invention can be used in practice. Such blades will sometimes be referred to as "Mechanically Binding Log Splitter Blades".

The Mechanically Binding Log Splitter Blades, one example shown in isolation in FIGS. 5-7, are designed so that they can be interchanged without the use of fasteners, hydraulics, or permanently attaching the blades to the splitter. Currently log splitters are produced with wedges, or blades, that are welded to the mainframe of the machine, or they are bolted onto either the main frame or the hydraulic cylinder. See, e.g., examples incorporated by reference earlier. With the mechanically binding blades of the present invention, the blades of the log splitter can be interchanged or replaced without having to uninstall or reinstall fasteners. This allows for fast transitions between blades. It also aids in the speed of splitting logs because different blades can be interchanged to maximize each stroke of the cylinder.

For installation, the blade assembly of FIGS. 5-7 is inserted into the mainframe as follows:

(a) The overall blade assembly of FIGS. 5-8 is brought to end of the mainframe assembly shown in FIG. 2. The horizontal plate 14 and the underlying support 16 are then inserted into the mainframe at a tipped-down angle. Plate 14 and support 16 should be inserted between vertical plates 1 as far as can be allowed by the geometry.

(b) Once inserted, the blade can then be leveled parallel with the top of the mainframe carriage slide plate 3. While the blade assembly is leveling, the stops shown in FIG. 8 will then slide into the serrated-shaped mechanical stops 4 exposed at that end of the mainframe. At this time, the welded structure in FIGS. 5-8 will be resting upon the serrated-shaped mechanical stops 4. Upon construction of the machine, there should be enough clearance between plate 14 and plate 3 so that the blade weldment is not held off of the serrated-shaped stops.

(c) With the blade now resting freely on the serrated-shaped stops, the user aligns the complementary serrations of mechanical stops 15 on the bottom of the blade assembly into the mechanical stops 4 on top of plates 1 of the mainframe assembly so that the teeth of the serrations of each set 15 and 4 mesh. This is shown in FIG. 11. As can be seen, the flat edges 15A on each of the four mechanical stops 15 on the blade assembly nest into and abut complementary flat edges 4A on both sides of the two mechanical stops 4. Those abutting flat edges are basically perpendicular to the longitudinal axis along the mainframe assembly and thus resist forward or rearward movement in the general direction of the mainframe assembly longitudinal axis (the Z direction). Thus, the mass of the whole blade assembly (at a minimum several pounds) will resist separation of the blade assembly from the mainframe assembly vertically (the Y direction) and, of course, the horizontal plate 14 of the blade assembly is a mechanical stop against the blade assembly moving vertically downward (the downward Y direction). The normal forces experienced by the vertical blade plates 13 during splitting would be primarily generally along the longitudinal axis of the mainframe. Here there are two vertical blades 13 each angled a bit relative to the longitudinal axis of the main beam and each other. Other blade configurations are possible (see non-limiting examples in the references incorporated by reference earlier) including single blades. Therefore, the meshed teeth of stops 15 and 4 resist separation of the blade assembly from the mainframe assembly during log splitting. As will be further discussed below, the insertion of blade assembly plate 14 into mainframe resist vertical separation of blade assembly from mainframe assembly as the blade assembly is fixed relative to the mainframe assembly when assembled, and the hydraulic-powered ram 8 pushes a log into the blade assembly with forces generally parallel the longitudinal axis of the mainframe assembly. Because much force will be experienced at the leading edge of blades 13 relative a log being split, and plate 14 of the blade assembly is held in the mainframe just forward of the blade leading edge, this arrangement deters vertical separation and promotes the continued meshing of the complementary teeth of mechanical stops 15 and 4 on the blade assembly and mainframe assembly respectively.

(d) Removal of the blade assembly is done the opposite way. The blade assembly is first pushed forward then lifted up (generally in the release direction) from the back to separate the teeth of the complementary mechanical stops 15 and 4 and then the whole blade assembly is removed rearward (generally in the Z direction) and at an angle from the end of the mainframe assembly to separate plate 14 of the blade assembly out of mainframe assembly. Both the blades and the mainframe are composed of welded plate steel plate that has been cut to specified geometries. Either the blades or the mainframe could be composed by casting, but it is thought that welded plate steel would be lighter and more cost effective. One non-limiting example of the steel plate would be ASTM-A36 of thickness/gauge of 3/8 inch. Of course, variations are possible according to the designer's need or desire. As will be appreciated by those skilled in this technology, the mainframe assembly typically would be robustly fixed to another structure. Non-limiting examples in the items incorporated by reference supra include a trailer, a bench or table, or a foundation. This can be done with appropriate fasteners (e.g. bolts) or fastening techniques (e.g. welding).

This machine was designed by thinking about the splitter in two dimensions. When the cylinder 10 (mounted at one end to the mainframe at mounting ears 11) applies a linear force via its piston rod to ram plate 8 that slides on carriage 5/6/7 captured on top plate 3 of the mainframe) there is both a horizontal force and a rotational moment that needs to be counteracted. The connection via ears 11 to the mainframe of the structure is what allows the cylinder 10 to apply force to one end of the log. Traditionally (see items incorporated by reference supra) on one end of the frame there is a cutting mechanism or a steel plate. It can be seen, in the drawings of FIGS. 1-4, that there is neither. There are however mechanical stops 4. These mechanical stops 4 are part of the binding system of the separate blade assembly of FIGS. 5-8. Welded onto the bottom plate 14 of the blade assembly are two sets of opposing mechanical stops 15. When the blade assembly is inserted onto the mainframe assembly, the stops 15 on the blade matchup to the stops 4 on the mainframe in a complementary meshing fashion. These stops 4 and 15 are used to oppose the forces applied horizontally (longitudinally of the mainframe assembly generally in the Z direction) and transversely (perpendicularly of the mainframe assembly generally in the X direction) by the cylinder. With the horizontal and transverse forces opposed, the only forces left are the rotational forces that are generated by the forces applied at the height of the cylinder above the top of the mainframe. These forces are generally modeled as a rotational moment around the center of mass and can be thought of as a torque. On the front of the blade assembly there is a convex extension 16 (basically a vertical support plate) on the weldment plate 14 that also supports the vertical blade 13 (and a top plate 12 over it). This extension 16 and supported front portion of weldment plate 14 are used to counter the rotational forces that would flip the blade assembly off of the mainframe assembly. With these two forces counter-acted, there is no movement in the blade (or such is effectively deterred during operation), and there is no further need to restrain it. This is how the blade assembly is restrained without the conventional use of fasteners or welding. Thus, the invention addresses what is referred to here as bi rotational torque. Background information on bi rotational or directional torque can be found, at WO 2002/063185A1 (PCT/GB2002/000021); US 2006/0214380 A1; and US 5669455, each of which is incorporated by reference herein.

Those of skill in this technical art therefore will appreciate that these embodiments of the invention meet at least one or more of the objects, features, advantages, or aspects of the invention. Each presents the technical benefits of manual insertion and removal of the blade assembly without need of tools, but with mechanical robustness and resistance to movement out of operating position when inserted; including the ability to take the significant forces such blades experience.

Options and Alternatives

As will be appreciated by those skilled in this technology, the exemplary embodiment discussed above is but one way to make and use the invention and its aspects. The main feature is use of cooperating mechanical structures or form factors on a removable blade assembly and a mainframe assembly that allow installation or removal of the blade assembly without fasteners or tools. Variations obvious to those skilled in this technology will be included within the invention, which is not limited to the specific exemplary embodiments shown and described.

For example, the drawings show the following dimensions:

| | | |
|---|---|---|
| Angle A1 | 60 | degrees |
| Angle A2 | 6 | degrees |
| Angle A3 | 60 | degrees |
| Angle A4 | 150 | degrees |
| Distance D1 | 0.8 | inch(es) |
| Distance D2 | 3 | inch(es) |
| Distance D3 | 1.25 | inch(es) |
| Distance D4 | 4.5 | inch(es) |
| Distance D5 | 0.25 | inch(es) |
| Distance D6 | 1.5 | inch(es) |
| Distance D7 | 0.05 | inch(es) |

These can vary according to the designer's need or desire. The form factor of the meshing structural features of the blade assembly and mainframe assembly can vary so long as they effectively retain blade assembly to mainframe assembly during log splitting. By further example, one set of teeth 15A on the blade assembly and one set of teeth 4A on the mainframe assembly may be sufficient for some purposes. The two sets of mechanical stops 15 (two opposing but spaced apart linear arrays of teeth 15A on one side of plate 16 for one set and two opposing but spaced apart linear arrays of teeth 15A on the other side of plate 16 for the other set), and two sets of mechanical stops 4 (two oppositely extending linear arrays of teeth 4A on one strip 4 for one set, and two oppositely extending linear arrays of teeth 4A on another strip 4 for the second set), provide additional abutment surfaces for more robust mechanical stop function against normal forces experienced during log splitting.

The use of the plate 14 on the blade assembly into the mainframe assembly is not necessarily required. Just meshing structures between blade and mainframe assemblies might be used. The plate 14 can improve deterrence of separation from rotational torque, as discussed above.

The scale of the overall machine can vary. For example, the length of the mainframe assembly can be longer than illustrated in the drawings, which are illustrative only. Lengths, widths, proportions can vary according to need or desire. The size and power of the hydraulic cylinder, as well as length of travel of ram 8 can be correlated accordingly. As will be appreciated, other types of actuators can be used to move a log into the blade(s) 13.

The mainframe illustrated has a bottom horizontal plate 2 that can be mounted to another structure, a top horizontal plate 3 spaced from bottom plate 2, and two laterally spaced vertical plates 1. The ram assembly essentially uses top plate 3 as a rail along which its carriage is both retained but allowed to slide longitudinally. This is accomplished by a bottom plate 7, a spaced-apart top plate 6, which sandwich a middle spacer 5 which form slots which receive the opposite lateral edges of the top plate 3. Flanges or buttresses 9 support vertical ram plate 8. Mounting ears on the cylinder-side of ram plate 8 receive and connect the distal end of the extendable piston rod of cylinder 10 (see FIGS. 9-11). Variations to this arrangement are, of course possible.

The specific form factor of the blade assembly can also vary. The version illustrated includes two vertical blade plates 13 sandwiched between a bottom plate 14 and a top plate 12.

As indicated earlier, the specific form factor of the meshing serrations or teeth on the blade assembly and on the main beam can vary. FIGS. 15-17 give one alternative embodiment. Shapes 18 on the blade assembly would mesh with shapes 17 on the main beam in a similar fashion to serrations 15 and 4 in FIGS. 1-14. FIGS. 18-20 give another alternative embodiment. In this case vertical protrusions or bosses 20 on the underside of plate 14 of the blade assembly would drop into complementary pockets or holes 19 on the top of plate 3 of the main beam. The arrangement, number, and size of the bosses 20 and pockets or holes 19 could vary. The above are just a few and non-limiting examples.

What is claimed is:

1. A log splitter machine comprising:

a. a log splitter main frame assembly having a surface between a ram end and an opposite end along a longitudinal axis, and having a side-to-side lateral axis and an up-and-down sagittal axis relative to the longitudinal axis;

b. a removable integrated log splitter blade and blade support assembly having a bottom support, a top support, and one or more blades extending between the bottom support and the top support along a blade assembly axis, c. a mechanical binding system comprising complementary mechanical structural features on the bottom support of the removable blade assembly and at or near the surface of the opposite end on the mainframe assembly that mesh when assembled together to resist movement of the blade assembly in all directions relative to the surface and longitudinal axis of the mainframe assembly except for separation in a separation direction other than parallel to the longitudinal axis;

wherein the complementary mechanical structural features comprise:

a slot system comprising a plurality of slots, each slot defined by an outside perimeter shape and a depth, and a key system comprising a plurality of keys, each key having a perimeter shape that fits in complementary fashion into a said slot.

2. The log splitter machine of claim 1 wherein the slot system extends generally in the direction of the longitudinal axis and the slots are exposed for meshing with a said key system.

3. The log splitter machine of claim 1 wherein the slot has a female perimeter shape comprising a triangular or tooth shape and the key has a male perimeter shape comprising a complementary triangular or tooth shape.

4. The log splitter machine of claim 1 wherein the slot comprises an aperture or hole and the key comprises a complementary peg or pin.

5. The log splitter machine of claim 1 further comprising:

a. further complementary structural features on or at the base of the removable blade assembly and inwardly of the opposite end of the mainframe assembly that resist rotation of the blade assembly relative the mainframe assembly in the separation direction when the complementary structural features are meshed.

6. The log splitter machine of claim 5 wherein the further complementary structural features comprise:

a. an extension member on one of the main frame assembly and the blade assembly;

b. a complementary receiver on the other of the main frame assembly and the blade assembly;

c. so that when the extension member is complementarily positioned in the receiver, rotation of the blade in the separation direction is resisted.

7. The log splitter machine of claim 1 in combination with a ram moveable along the longitudinal axis and an actuator to move the ram.

8. A method of splitting logs or other objects comprising:

a. providing a log splitter main frame assembly having opposite ends along an end-to-end longitudinal axis, and having a side-to-side lateral axis and an up-and-down sagittal axis relative to the longitudinal axis, the longitudinal and lateral axis defining a longitudinal plane;

b. holding a removable integrated log splitter blade assembly, having a bottom, a top, and one or more blades extending between the bottom and the top, in place at or near the longitudinal plane of the log splitter main frame assembly by mechanical binding not comprised of fasteners between the bottom of the blade assembly and the main frame assembly, wherein the complementary mechanical structural features comprise a slot system comprising a plurality of slots, each slot defined by an outside perimeter shape and a depth, and a key system comprising a plurality of keys, each key having a perimeter shape that fits in complementary fashion into a said slot, wherein the mechanical binding influences freedom of movement of the blade assembly relative to the mainframe assembly as follows:

i. provides restraint against translation along the longitudinal axis, along the lateral axis, and downwardly along the sagittal axis; and ii. allows releasable translation upwardly in a separation direction along the sagittal axis for a release distance near the longitudinal plane of the main frame assembly;

c. so that the blade assembly can be installed, removed, or interchanged at or near the longitudinal plane of the main frame assembly without tools, resist longitudinal movement during log splitting but allow interchangeability of blade assemblies in the separation direction.

9. The method of claim 8 wherein the mechanical binding further influences freedom of movement of the blade assembly relative to the mainframe assembly as follows:

a. provides restraint against rotation around the lateral axis when the blade assembly is held by the mechanical binding on the mainframe assembly.

10. The method of claim 8 wherein the slot system is positioned in the direction of the longitudinal axis.

11. The method of claim 10 wherein the slot system comprises a series of slots.

12. The method of claim 9 wherein the restraint against rotation comprises:

a. an extension member on one of the main frame assembly and the blade assembly;

b. a complementary receiver on the other of the main frame assembly and the blade assembly;

c. so that when the extension member is complementarily positioned in the receiver, rotation of the blade in the separation direction is resisted.

13. The method of claim 12 wherein the extension member comprises a plate having a width relative the lateral axis and the receiver comprises a slot having a width relative the lateral axis and height relative the sagittal axis, and is open for receiving the extension.

14. A powered ram machine comprising:

a. a main frame assembly having opposite ends along an end-to-end longitudinal axis, and orthogonal side-to-side lateral and up-and-down sagittal axes relative to the longitudinal axis, the longitudinal and lateral axes defining a longitudinal plane;

b. one or more blade assemblies, each of the one or more blade assemblies comprising a bottom support and one or more blades extending from the bottom support to a top, and each of the one or more blade assemblies adapted to be removably mountable in place at or near the longitudinal plane of the main frame assembly by mechanical binding at or near the longitudinal plane of the main frame assembly;

c. a mechanical binding system comprising complementary mechanical structural features on the bottom support of the removable blade assembly and on the mainframe assembly that allow meshing when assembled together at or near the longitudinal plane of the main frame assembly to resist relative movement of the mainframe assembly in any direction except for separation in a separation direction other than parallel to the longitudinal axis;

wherein the complementary mechanical structural features comprise:

a slot system comprising a plurality of slots, each slot defined by an outside perimeter shape and a depth, and a key system comprising a plurality of keys, each key having a perimeter shape that fits in complementary fashion into a said slot.

15. The powered ram machine of claim 14 wherein:

a. a ram is mounted on the mainframe and translatable along the longitudinal axis; and b. an actuator operably connected to the ram to translate the ram.

16. The powered ram machine of claim 15 wherein the actuator comprises:

a. a hydraulic cylinder and pump; and b. a motor to operate the pump.

* * * * *